US009546444B2

(12) United States Patent
Hasan-Reisoglu et al.

(10) Patent No.: US 9,546,444 B2
(45) Date of Patent: Jan. 17, 2017

(54) WASHING MACHINE WHEREIN THE UNBALANCED LOAD IS BALANCED

(75) Inventors: Ali Levent Hasan-Reisoglu, Istanbul (TR); Ersin Donmez, Istanbul (TR); Mehmet Durmaz, Istanbul (TR); Mehmet Uzuner, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 926 days.

(21) Appl. No.: 13/509,614

(22) PCT Filed: Oct. 27, 2010

(86) PCT No.: PCT/EP2010/066240
§ 371 (c)(1),
(2), (4) Date: May 13, 2012

(87) PCT Pub. No.: WO2011/057893
PCT Pub. Date: May 19, 2011

(65) Prior Publication Data

US 2012/0222455 A1 Sep. 6, 2012

(30) Foreign Application Priority Data

Nov. 13, 2009 (TR) ..... a 2009/08629

(51) Int. Cl.
*D06F 37/22* (2006.01)
*B29C 45/00* (2006.01)
*B23P 11/02* (2006.01)

(52) U.S. Cl.
CPC ..... *D06F 37/225* (2013.01); *Y10T 29/49876* (2015.01)

(58) Field of Classification Search
CPC ..... D06F 37/225; Y10T 29/49876
USPC ..... 68/3 R, 142
See application file for complete search history.

(56) References Cited

U.S. PATENT DOCUMENTS

| | | | | |
|---|---|---|---|---|
| 3,332,259 | A * | 7/1967 | Zylstra | 68/18 F |
| 5,546,772 | A * | 8/1996 | Merlin et al. | 68/24 |
| 2004/0123633 | A1* | 7/2004 | Jo | 68/23 R |
| 2006/0123854 | A1* | 6/2006 | Hong et al. | 68/19.1 |
| 2007/0137260 | A1* | 6/2007 | Shikamori et al. | 68/3 R |

FOREIGN PATENT DOCUMENTS

| | | | |
|---|---|---|---|
| JP | 2002136792 | A | 5/2002 |
| WO | 2008125498 | A1 | 10/2008 |
| WO | 2010043273 | A1 | 4/2010 |

* cited by examiner

*Primary Examiner* — Michael Barr
*Assistant Examiner* — Benjamin L Osterhout
(74) *Attorney, Agent, or Firm* — Kilpatrick Townsend & Stockton LLP

(57) ABSTRACT

The present invention relates to a washing machine (1) comprising one or more than one receptacle (12) placed on the drum (2) wherein a sufficient amount of water delivered for counterbalancing the unbalanced load is stored when there is an unbalanced load.

7 Claims, 5 Drawing Sheets

WASHING MACHINE WHEREIN THE UNBALANCED LOAD IS BALANCED

Figure 1:
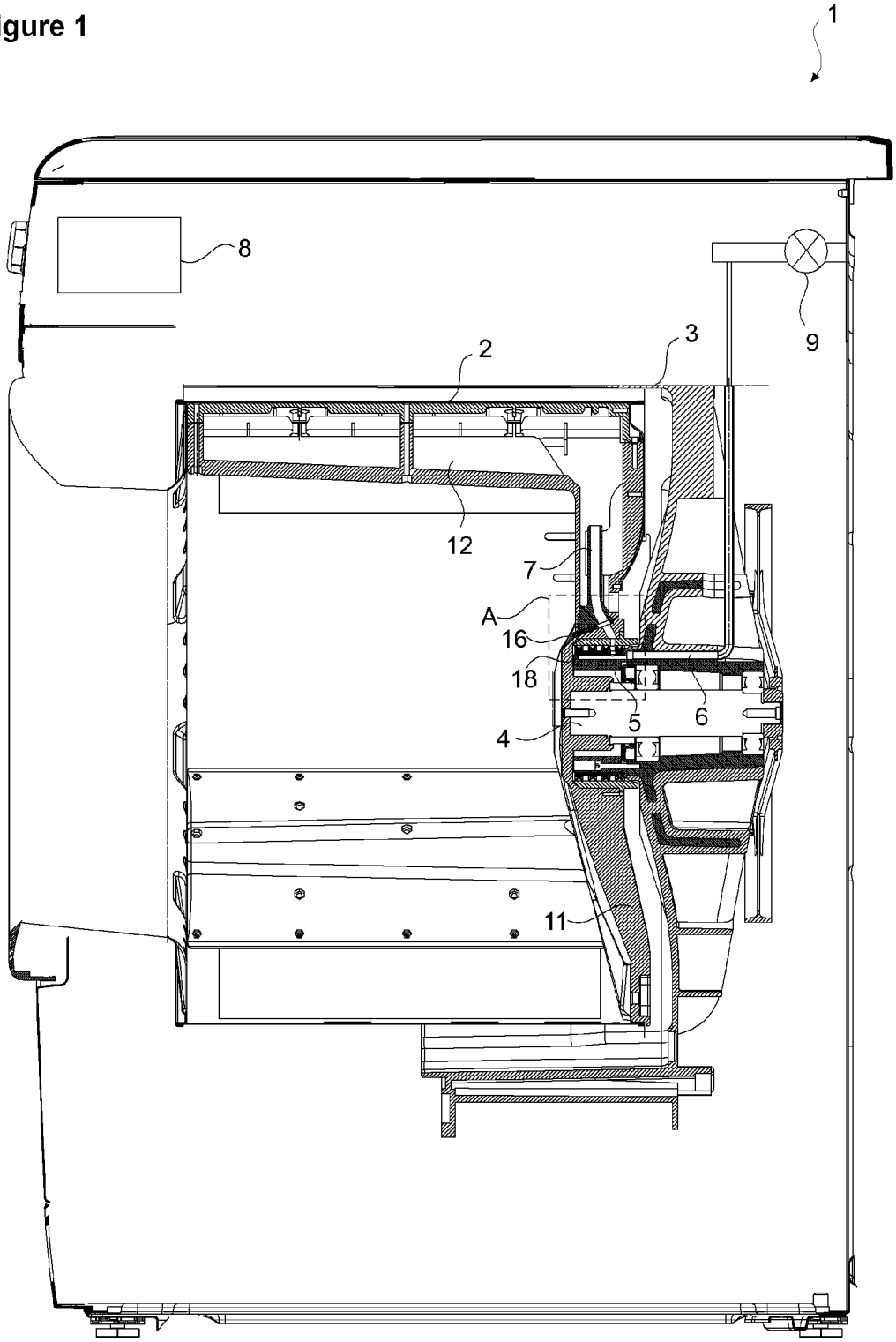

This invention relates to a washing machine wherein the unbalanced load within the drum is balanced by using a fluid.

In washing machines, the laundry is placed inside a drum that rotates preferably around a horizontal axis. In different steps of the washing program, the laundry is cleaned by means of water and detergent by rotating the drum at different speeds. While the drum is being rotated, the laundry is not distributed homogeneously inside the drum, causing an uneven distribution of the laundry by piling up in some regions. Particularly in the spin-drying step where the drum is being rotated at high speeds, the uneven distribution of the load causes vibration. Those vibrations not only generate noise and result in consumer dissatisfaction but also cause the machine to wear out. Furthermore, the spin-drying performance at high speeds is adversely affected.

In the state of the art, various solutions have been developed for balancing the unbalanced load. A widely used solution is adding weights to the machine and increasing its inertia. However, since the immovable weights complicate the transportation of the machine, in the state of the art embodiments, adding liquid, mostly water, to the machine is suggested. Water is filled in the receptacles fixed on the tub or the drum. In a group of embodiments, the fluid is added to the machine once after the transportation and the same liquid is used continuously. In another group of embodiments, the fluid required for balancing is taken into the machine while the machine is operating, and discharged at the end of the operation.

In state of the art Japanese Patent Application No JP2002136792, an additional grooved element is described which bears against the shaft bearing and which directs water to be delivered to water storage tanks on the drum when there is unbalanced load. This additional element does not rotate and the water in the groove is delivered to the water storage tanks while the shaft bearing rotates by means of a channel.

In the state of the art International Patent Application No. WO2008/125498, delivering water to the receptacles in the drum over the bearing wherein the drum shaft is borne for balancing is explained.

The aim of the present invention is the realization of a washing machine wherein the unbalanced load is effectively balanced.

The washing machine realized in order to attain the aim of the present invention, explicated in the first claim and the respective claims thereof, comprises the cylindrical stationary protrusion located on the tub, the cylindrical housing situated on the rear wall, rotating together with the drum, surrounding the protrusion such that a distance remains therebetween, an insert mounted between the protrusion and the housing which joins the supply line on the tub and the distribution line on the drum.

The insert comprises a cylindrical hollow body and sealing elements in bracket form mounted on the body. The supply line and the distribution line open to the compartments between the sealing elements. At least one opening is disposed on each compartment, on the body for the water received from the supply line passing to the distribution line.

The sealing elements prevent water passage between the compartments by confining the compartment leak-proofingly. Thus, the required amount of water is provided to be delivered from the supply line to the distribution line and the respective receptacle without any leakage or seepage.

In an embodiment of the present invention, the insert is fixed into the housing. The opening is overlapped with the distribution line. In this embodiment the insert rotates together with the drum.

In another embodiment of the present invention, the insert is fixed onto the protrusion. The opening is overlapped with the supply line. In this embodiment, the insert does not rotate.

In an embodiment of the present invention, the body is produced by injecting elastomer material over the sealing elements placed into the injection mould.

In another embodiment of the present invention, the insert comprises a ring-shaped holder on which one sealing element is mounted. The holder is produced from metal or plastic material.

In a variation of this embodiment, the body is produced by injecting elastomer material over the holders placed into the injection mould.

In another variation of this embodiment, the insert comprises a recess and a detent means situated on the holder.

In a variation of this embodiment, the body is produced by more than one holder locking to each other by the snap fit method such that the detent means seat into the recesses. In a variation of this embodiment, the outer surfaces of the holders are covered with elastomer material.

In another embodiment of this embodiment, the body is produced by fastening more than one holder produced from metal material by snap fit method such that the detent means seat into the recesses. In a variation of this embodiment, the outer surfaces of the holders are covered with elastomer material.

The imbalances occurring as the result of the variable distribution of the laundry in the drum during the rotation of the drum are balanced by means of the fluid transferred to the receptacles on the drum. The transfer of the water transferred to the receptacles from the supply line on the tub at fixed position to the distribution line on the rotating drum is provided by means of the compartments formed by the sealing elements on the insert between the supply line and the distribution line. Since more than one sealing element are integrated on the insert, the mounting of the sealing elements in one go is provided by means of the insert. Thus, the distance between the sealing elements remaining fixed during the assembly is guaranteed.

A washing machine realized in order to attain the aim of the present invention is illustrated in the attached figures, where:

FIG. 1—is the schematic view of a washing machine.

Figure 2:
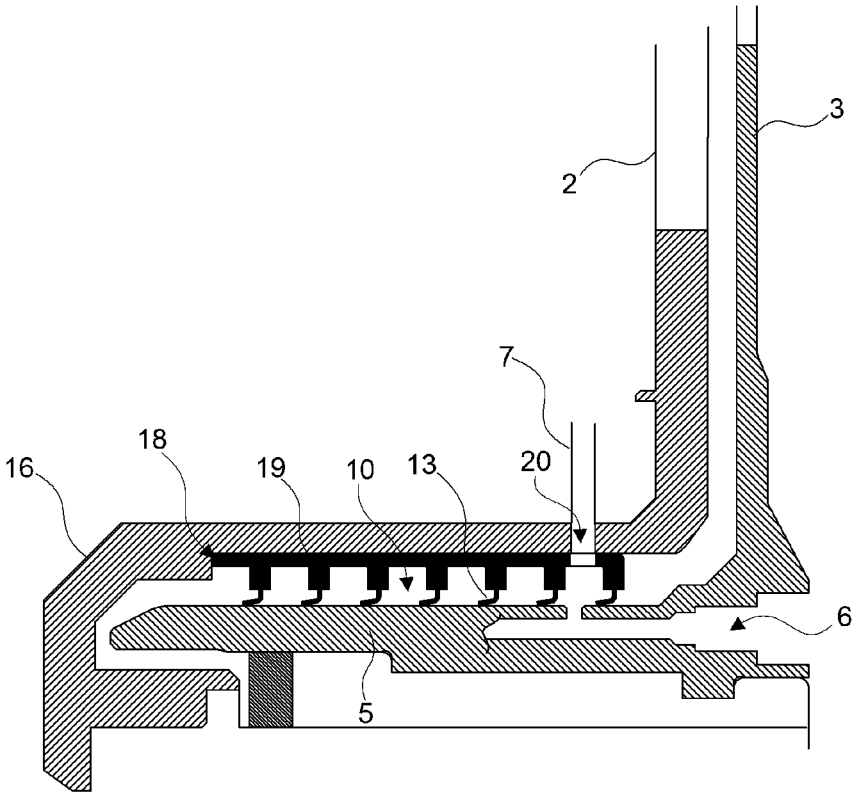

FIG. 2—is the view of detail A in FIG. 1 in the first embodiment of the present invention.

Figure 3:
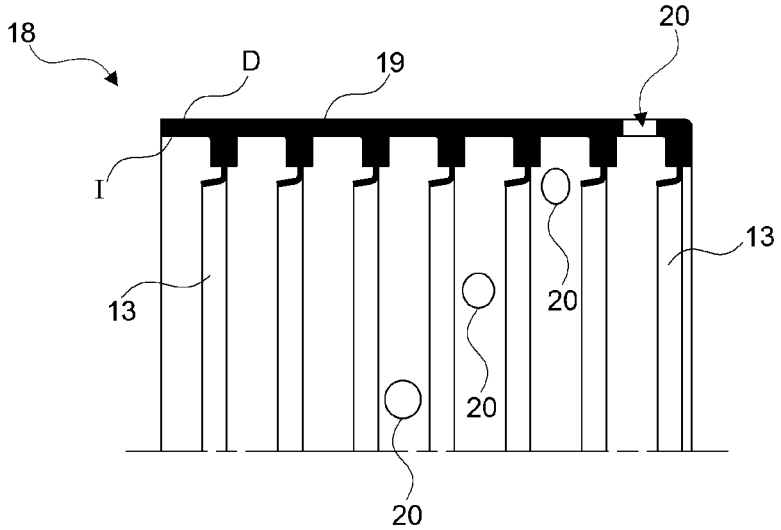

FIG. 3—is the partial cross-sectional view of the insert in the first embodiment of the present invention.

Figure 4:
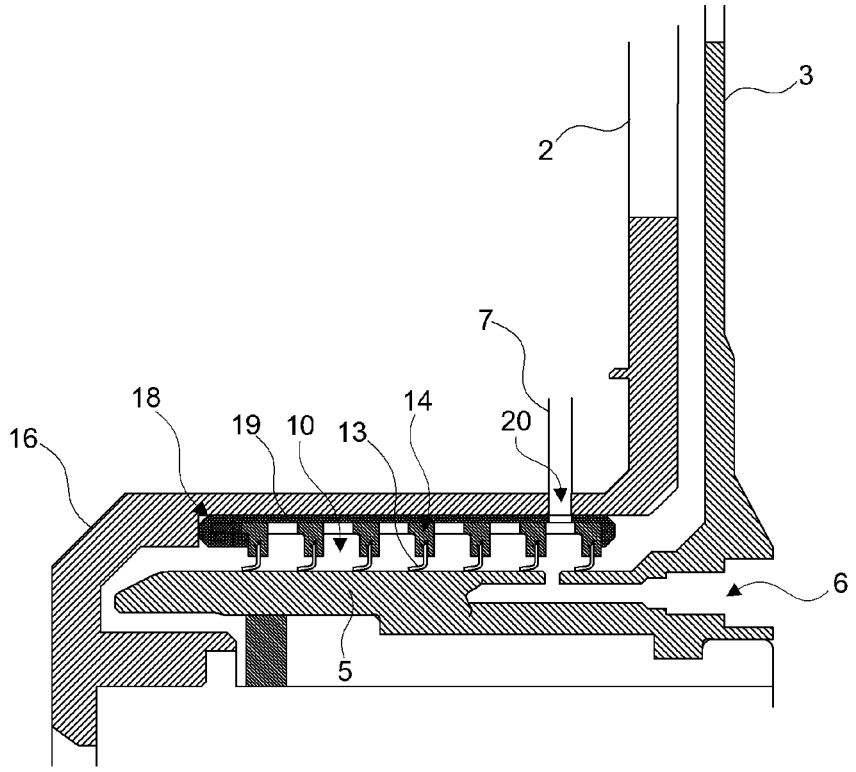

FIG. 4—is the view of detail A in FIG. 1 in the second embodiment of the present invention.

Figure 5:
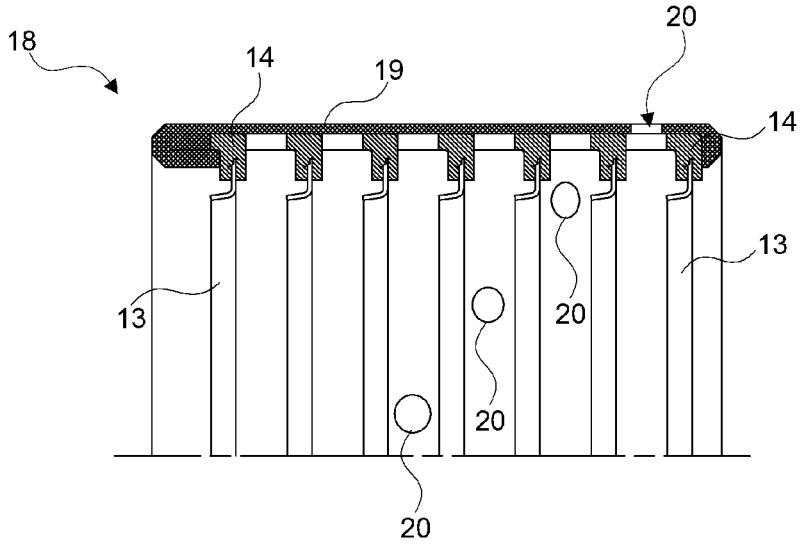

FIG. 5—is the partial cross-sectional view of the insert in the second embodiment of the present invention.

Figure 6:
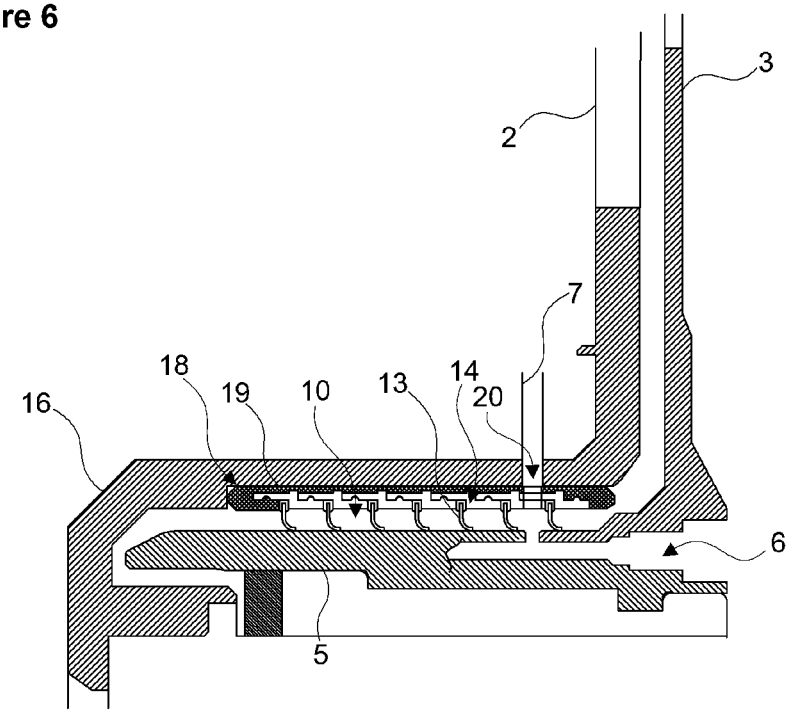

FIG. 6—is the view of detail A in FIG. 1 in the third embodiment of the present invention.

Figure 7:
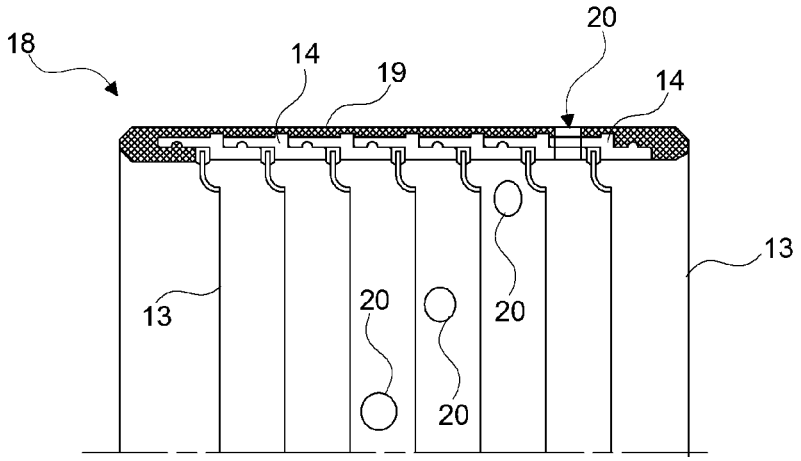

FIG. 7—is the partial cross-sectional view of the insert in the third embodiment of the present invention.

Figure 8:
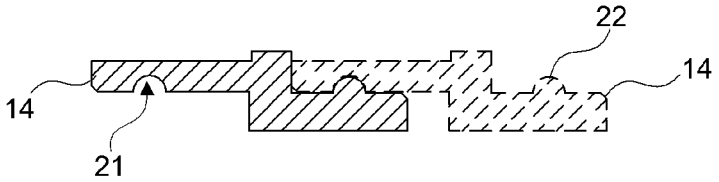

FIG. 8—is the partial cross-sectional view of a holder in the third embodiment of the present invention.

Figure 9:
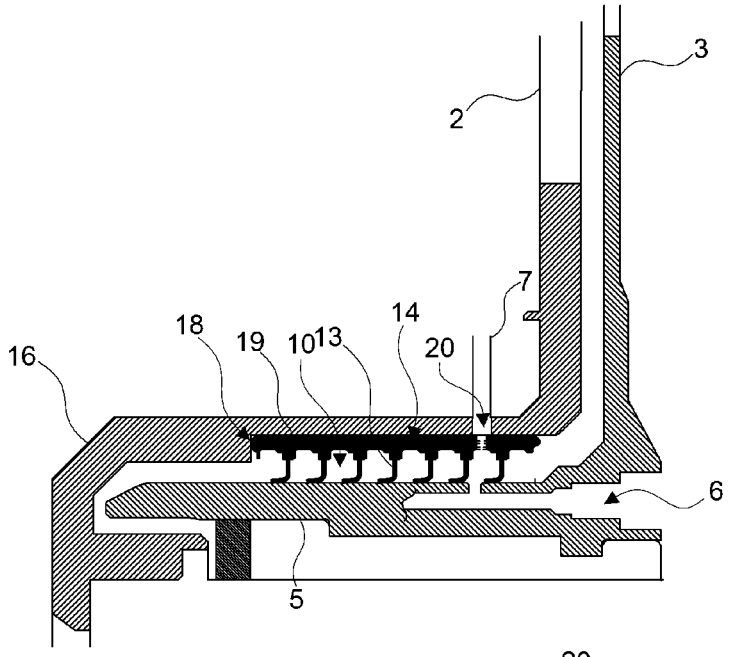

FIG. 9—is the view of detail A in FIG. 1 in the fourth embodiment of the present invention.

Figure 10:
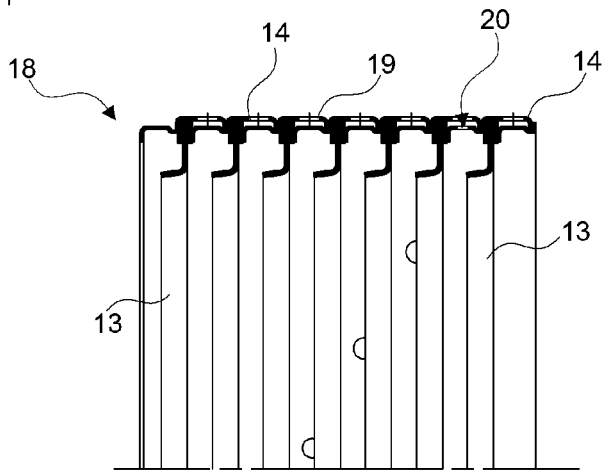

FIG. 10—is the partial cross-sectional view of the insert in the fourth embodiment of the present invention.

Figure 11:
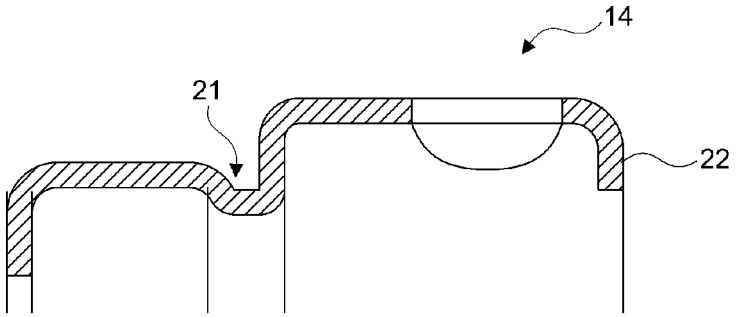

FIG. 11—is the partial cross-sectional view of a holder in the fourth embodiment of the present invention.

The elements illustrated in the figures are numbered as follows:

1. Washing machine
2. Drum
3. Tub
4. Shaft
5. Protrusion
6. Supply line
7. Distribution line
8. Control unit
9. Valve
10. Compartment
11. Rear wall
12. Receptacle
13. Sealing element
14. Holder
16. Housing
18. Insert
19. Body
20. Opening
21. Recess
22. Detent means The washing machine (1) of the present invention comprises a rotating drum (2) wherein the laundry to be washed is placed, which has a rear wall (11), a tub (3) wherein the drum (2) moves, a motor which provides the rotation of the drum (2), a shaft (4) which delivers the movement received from the motor to the drum (2) and which is borne to the tub (3) and one or more than one receptacle (12) situated on the drum (2), in which fluid is transferred to meet the unbalanced load when unbalanced load occurs (FIG. 1).

The washing machine (1) comprises

- a stationary cylindrical protrusion (5) situated on the tub (3),
- a cylindrical housing (16) situated on the rear wall (11), surrounding the protrusion (5) concentrically such that a distance remains therebetween, rotating together with the drum (2),
- at least one supply line (6) situated on the tub (3), having an inlet connected to the mains and an outlet situated on the surface of the protrusion (5) facing the housing (16),
- at least one distribution line (7) situated on the rear wall (11), rotating together with the drum (2), one end of which is connected to the receptacle (12), the other end opening to the surface of the housing (16) facing the protrusion (5),
- an insert (18) fixed onto the protrusion (5) or into the housing (16) such as to remain between the protrusion (5) and the housing (16), joining the supply line (6) and the distribution line (7) leak-proofingly (FIG. 1).

The insert (18) comprises a hollow cylindrical body (19), more than one ring-shaped sealing element (13) arranged one behind the other, almost parallel to each other on the inner surface (I) or the outer surface (D) of the body (19), more than one compartment (10) remaining between the sealing elements (13), into each one of which one distribution line (7) inlet and one supply line (6) outlet open and at least one opening (20) situated on the body (19) and in each compartment (10), providing the connection between the supply and distribution lines (6 and 7) (FIG. 3).

The insert (18) is mounted onto the protrusion (5) or into the housing (16) by snap fitting. If need be, adhesive is used for fixing. By means of the insert (18), assembly of more than one sealing element (13) is realized in one go, easily and quickly. Moreover, the distance between the sealing elements (13) is preserved during the assembly without any change.

The washing machine (1) furthermore comprises at least one valve (9) disposed on the supply line (6) for controllably receiving water from the mains to the supply line (6) and a control unit (8) which identifies the amount and position of the unbalanced load when unbalanced load is detected to decide how much water will be received into which receptacle (12) and which opens, closes the valves (9) accordingly (FIG. 1).

When the washing machine (1) is operated, the receptacle (12) and the distribution line (7) rotate together with the drum (2). When unbalanced load is detected by the control unit (8), the amount and position of the unbalanced load is determined and the control unit (8) decides which receptacle (12) on the drum (2) will receive how much water. The control unit (8) provides the determined amount of water to be directed to the receptacles (12) at the determined time by opening and closing the valves (9). According to this decision, the valve (9) situated on the supply line (6) connected to the mains opens. Water flowing through the supply line (6) reaches the supply line (6) outlet and passes from the supply line (6) outlet into the compartment (10). The water passing through the opening (20) is directed to the water distribution line (7) inlet opening to the compartment (10). Water taken from the compartment (10) into the distribution line (7) reaches the respective receptacle (12).

By means of the sealing elements (13) produced from plastic, teflon etc. material, complete leak-proofing is provided between the compartments (10). Thus, no loss occurs during the transfer of the water coming from the supply line (6) to the distribution line (7) and the receptacle (12). Moreover, water coming from the supply line (6) can pass to the distribution line (7) and the receptacle (12) even when the drum (2) does not move.

The sealing elements (13) surrounding the outlet of the each supply line (6) open to a confined compartment (10), a distribution line (7) inlet is connected to each compartment (10). In other words, the outlet of each supply line (6) and the inlet of each distribution line (7) remain between two sealing elements (13) defining the compartment (10). By means of the opening (20) situated on the body (19), the water leaving the supply line (6) is provided to pass to the distribution line (7) over the compartment (10). Water is delivered to each receptacle (12) by passing through a supply line (6), a compartment (10), an opening (20) and a distribution line (7). Consequently water can be delivered to each receptacle (12) independently.

In an embodiment of the present invention, the insert (18) is fixed into the housing (16). In this embodiment the sealing elements (13) are mounted onto the inner surface (I) of the body (19). Free ends of the sealing elements (13) apply pressure by bearing against the protrusion (5). Since the housing (16) rotates together with the drum (2), the insert (18), consequently the sealing elements (13) also rotate together with the drum (2). In this embodiment, the insert (18) is fixed into the housing (16) such that the opening (20) and the distribution line (7) inlet overlap. Thus the passage of the water coming from the supply line (6) into the compartment (10) to the distribution line (7) is provided by means of the opening (20).

In another embodiment of the present invention, the insert (18) is fixed onto the protrusion (5). In this embodiment the sealing elements (13) are mounted onto the outer surface (D) of the body (19). Free ends of the sealing elements (13) apply pressure by bearing against the inner surface of the housing (16). Since the protrusion (5) remains still together with the tub (3), the insert (18), consequently the sealing elements (13) also remain still together with the tub (3). In this embodiment, the insert (18) is fixed onto the protrusion (5) such that the opening (20) and the supply line (6) outlet overlap. Thus the passage of the water coming from the supply line (6) to the compartment (10) is provided by means of the opening (20).

In an embodiment of the present invention, the opening (20) has a diameter significantly bigger than the distribution line (7) inlet and/or the supply line (6) outlet. Overlapping the opening (20) with the distribution line (7) inlet or the supply line (6) outlet during the mounting of the insert (18) into the housing (16) or onto the protrusion (5) is facilitated.

In an embodiment of the present invention, three receptacles (12) are situated on the drum (2) having 120° angles therebetween, three supply lines (6) on the tub (3) and three distribution lines (7) on the rear wall (11). In this embodiment, moreover, three compartments (10) to each one of which a distribution line (7) inlet and a supply line (6) outlet open are disposed side by side. The supply lines (6) have different lengths and the outlet of each one opens into a compartment (10). Thus, depending on to which receptacle (12) water is intended to be delivered, the valve (9) on the supply line (6) that delivers water to that receptacle (12) is opened. In this embodiment, the receptacles (12) are inside the baffle ribs situated inside the drum (2).

In an embodiment of the present invention, the body (19) is produced by injecting elastomer material over the sealing elements (13) placed into the injection mould (FIG. 2 and FIG. 3).

In another embodiment of the present invention, the insert (18) comprises more than one ring-shaped holder (14) on which one sealing element (13) is mounted. The holder (14) is produced from metal or plastic material.

In a variation of this embodiment, the body (19) is produced by injecting elastomer material over the holders (14) placed into the injection mould (FIG. 4 and FIG. 5).

In another variation of this embodiment, the insert (18) comprises a recess (21) and a detent means (22) situated on the holder (14) (FIG. 8 and FIG. 11).

In a variation of this embodiment, the body (19) is produced by more than one holder (14) locking to each other by the snap fit method such that the detent means (22) seat into the recesses (21) (FIG. 6, FIG. 7 and FIG. 8). In a variation of this embodiment, the outer surfaces of the holders (14) are covered with elastomer material.

In another variation of this embodiment, the body (19) is produced by fastening more than one holder (14) produced from metal material by snap fit method such that the detent means (22) seat into the recesses (21) (FIG. 9, FIG. 10 and FIG. 11). In a variation of this embodiment, the outer surfaces of the holders (14) are covered with elastomer material.

In another embodiment of the present invention, the sealing element (13) is bent towards one of the compartments (10) that it separates (FIG. 2 and FIG. 3).

By means of the present invention, when the control unit (8) detects a condition of unbalanced load, required amount of water for decreasing the effect to a minimum by counterbalancing the unbalanced load is provided to be mechanically and constantly delivered to the required receptacle (12) for decreasing the effect to a minimum.

It is to be understood that the present invention is not limited to the embodiments disclosed above and a person skilled in the art can easily introduce different embodiments. These different embodiments should also be considered within the scope of the claims of the present invention.

The invention claimed is:

1. A washing machine (1) comprising a rotating drum (2) wherein the laundry to be washed is placed, which has a rear wall (11), a tub (3) wherein the drum (2) moves, a motor which provides the rotation of the drum (2), a shaft (4) which delivers the movement received from the motor to the drum (2) and which is borne to the tub (3) and one or more than one receptacle (12) situated on the drum (2), in which fluid is transferred to meet an unbalanced load when an unbalanced load occurs, a stationary cylindrical protrusion (5) situated on the tub (3), a cylindrical housing (16) situated on the rear wall (11), surrounding the protrusion (5) concentrically such that a distance remains therebetween, rotating together with the drum (2), at least one supply line (6) situated on the tub (3), having an inlet connected to a mains and an outlet situated on the surface of the protrusion (5) facing the housing (16) and at least one distribution line (7) situated on the rear wall (11), rotating together with the drum (2), one end of which is connected to the receptacle (12), the other end opening to the surface of the housing (16) facing the protrusion (5), characterized by an insert (18) including a hollow cylindrical body (19), more than one ring-shaped sealing element (13) arranged one behind the other, almost parallel to each other on the inner surface (I) or the outer surface (D) of the body (19)

more than one compartment (10) remaining between the sealing elements (13), into each one of which one distribution line (7) inlet and one supply line (6) outlet open and at least one opening (20) situated on the body (19) and in each compartment (10), providing the connection between the supply and distribution lines (6 and 7), the insert (18) being fixed onto the protrusion (5) such as to remain between the protrusion (5) and the housing (16), the insert being mounted onto the protrusion (5) such that the opening (20) and the supply line (6) outlet overlap and the sealing elements (13) mounted on the outer surface (D) of the body (19), and free ends of said sealing elements (13) bear against the inner surface of the housing (16) and wherein the sealing elements (13), produced from metal or plastic material, comprises more than one ring-shaped holder (14) and said insert (18) comprises a recess (21) and a detent means (22) situated on said more than one holder (14).

2. The washing machine (1) as in claim 1, characterized by the body (19) produced by injecting elastomer material over the sealing elements (13) placed into the injection mould.

3. The washing machine (1) as in claim 1, characterized by the body (19) produced by more than one holder (14) locking to each other by the snap fit method such that the detent means (22) seat into the recesses (21).

4. The washing machine (1) as in claim 1, characterized by the body (19) produced by fastening more than one holder (14) produced from metal material by snap fit method such that the detent means (22) seat into the recesses (21).

5. The washing machine (1) as in claim 3 or 4, characterized by the holders (14) the outer surfaces of which are covered with elastomer material.

6. The washing machine (1) as in claims 1, 2, 3 or 4, characterized by the opening (20) having a diameter bigger than the distribution line (7) inlet and/or the supply line (6) outlet.

7. The washing machine (1) as in claim 5, characterized by the opening (20) having a diameter bigger than the distribution line (7) inlet and/or the supply line (6) outlet.

* * * * *